US008863774B2

(12) United States Patent
Wang

(10) Patent No.: US 8,863,774 B2
(45) Date of Patent: Oct. 21, 2014

(54) WATER FLOW CONTROLLER FOR FAUCET

(76) Inventor: Hsiang Hung Wang, Changhua Hsien (TW)

( * ) Notice: Subject to any disclaimer, the term of this patent is extended or adjusted under 35 U.S.C. 154(b) by 378 days.

(21) Appl. No.: 13/440,140

(22) Filed: Apr. 5, 2012

(65) Prior Publication Data

US 2013/0264505 A1 Oct. 10, 2013

(51) Int. Cl.
*F16K 31/02* (2006.01)

(52) U.S. Cl.
USPC ..... 137/599.11; 137/601.14; 137/613; 251/129.04; 4/623

(58) Field of Classification Search
CPC ..... F16K 31/02; E03C 1/057
USPC ..... 251/129.04; 4/623; 137/599.05, 599.11, 137/601.14, 613
See application file for complete search history.

(56) References Cited

U.S. PATENT DOCUMENTS

| | | | | |
|---|---|---|---|---|
| 4,335,852 | A | 6/1982 | Chow | |
| 4,562,865 | A | 1/1986 | Lemkin et al. | |
| 5,979,776 | A | 11/1999 | Williams | |
| RE37,888 | E * | 10/2002 | Cretu-Petra | 251/129.04 |
| 6,962,168 | B2 | 11/2005 | McDaniel et al. | |
| 6,968,860 | B1 * | 11/2005 | Haenlein et al. | 251/129.04 |
| 7,690,395 | B2 * | 4/2010 | Jonte et al. | 251/129.04 |

* cited by examiner

*Primary Examiner* — Eric Keasel
(74) *Attorney, Agent, or Firm* — Charles E. Baxley

(57) ABSTRACT

An automatic water flow controller for a faucet includes an outlet member, a manual valve device, one or more inlet pipes supplying water to the manual valve device, a coupling tube coupled between the outlet member and the manual valve device, a solenoid valve attached to the coupling tube for controlling the water to selectively flow through the coupling tube, and an infrared ray detector attached to the outlet member for detecting an approaching of a user within a detection zone of the infrared ray detector, the infrared ray detector is electrically connected to the solenoid valve for operating the solenoid valve to control the water to selectively flow through the coupling tube.

1 Claim, 4 Drawing Sheets

WATER FLOW CONTROLLER FOR FAUCET

BACKGROUND OF THE INVENTION

1. Field of the Invention

The present invention relates to a water flow controller or controlling device for a faucet assembly, and more particularly to an automatic water flow controller for automatically controlling a faucet device to deliver the water when detecting an approaching of a user to the faucet device.

2. Description of the Prior Art

Typical automatic water flow controllers comprise a control mechanism for automatically controlling a faucet to deliver the water for a predetermined time interval and for flushing or cleaning purposes.

For example, U.S. Pat. No. 4,335,852 to Chow, and U.S. Pat. No. 4,562,865 to Lemkin et al. disclose two of the typical fluid flow controlling devices including a timed water shut-off device for controlling the faucet to deliver the water for a predetermined time interval.

However, normally, the typical fluid flow controlling devices comprise a complicated structure and are controlled manually and may not automatically control the faucet to deliver the water when a user approaches to the faucet.

U.S. Pat. No. 5,979,776 to Williams discloses another typical water flow and temperature controller for a bathtub faucet including a panel surrounds the standard bath tub water valves, and a control assembly within the panel is communicative with the temperature sensors in the shower head and the bath tub faucet as well as control valves on the hot and cold water supply lines.

However, similarly, the typical water flow and temperature controller is controlled manually and may not automatically control the faucet to deliver the water when a user approaches or moves close to the faucet. In addition, an additional battery or power supply is further required to be provided and attached or coupled to energize the typical water flow and temperature controller and will be consumed quickly and should be replaced or changed with the new ones often.

U.S. Pat. No. 6,962,168 to McDaniel et al. discloses a further typical capacitive touch-controlled automatic faucet comprising a spout, a magnetically latching valve, a proximity sensor, a handle, a capacitive touch-control, and a logical control, the proximity sensor is sensitive to motion of objects within a detection zone of the proximity sensor, the handle determines a water flow rate and temperature, the capacitive touch-control is positioned in the spout and generates an output signal while the touch-control is in contact with a user.

However, the capacitive touch-control is positioned in the spout and is required to be in contact with a user in order to actuate or to operate the touch-control to generate an output signal, such that germs and contaminants may be contacted and transferred from people to people. In addition, the touch-control may be affected or interfered by noises or outer signals and may be false actuated or operated inadvertently.

The present invention has arisen to mitigate and/or obviate the afore-described disadvantages of the conventional automatic water flow controllers for faucets.

SUMMARY OF THE INVENTION

The primary objective of the present invention is to provide an automatic water flow controller for a faucet device and for automatically controlling a faucet device to deliver the water when detecting an approaching of a user to the faucet device.

The other objective of the present invention is to provide an automatic water flow controller for a faucet device including an infrared ray detector for precisely and accurately detecting an approaching of a user to the faucet device.

In accordance with one aspect of the invention, there is provided an automatic water flow controller for a faucet comprising an outlet member including an outlet port for delivering water, a manual valve device including a handle that controls the manual valve device, at least one inlet pipe coupled to the manual valve device for supplying the water into the manual valve device, a coupling tube coupled between the outlet member and the manual valve device for supplying the water from the manual valve device to the outlet member and the outlet port of the outlet member selectively, the manual valve device including a control valve member to control the water to selectively flow into the coupling tube, a solenoid valve attached to the coupling tube for controlling the water to selectively flow through the coupling tube, and an infrared ray detector attached to the outlet member for detecting an approaching of a user within a detection zone of the infrared ray detector, the infrared ray detector being electrically connected to the solenoid valve for operating the solenoid valve to control the water to selectively flow through the coupling tube, the infrared ray detector actuating the solenoid valve to control the water to selectively flow through the coupling tube when the infrared ray detector detects a first approaching of the user to the infrared ray detector, and to selectively switch off the solenoid valve when the infrared ray detector detects a second approaching of the user to the infrared ray detector.

A bypass may further be provided and attached to the coupling tube, and the bypass including a first end coupled to the coupling tube at an upstream side of the solenoid valve, and including a second end coupled to the coupling tube at a downstream side of the solenoid valve for allowing the water to selectively flow through the bypass, without flowing through the solenoid valve, and for allowing the solenoid valve to be fixed or repaired or changed with the new ones when the solenoid valve id damaged or out of order.

The first end of the bypass is preferably coupled to the coupling tube with a valve element, such as a three-way valve element for controlling the water to selectively flow through the coupling tube without flowing through the solenoid valve.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 2 is a partial top plan schematic view illustrating the operation of the automatic water flow controller for the faucet device or the like;

FIG. 3 is a further partial plan schematic view similar to FIG. 1, illustrating the other arrangement of the automatic water flow controller for the faucet device or the like; and FIG. 4 is a block diagram illustrating the actuation or operation of the automatic water flow controller for the faucet device or the like.

DETAILED DESCRIPTION OF THE PREFERRED EMBODIMENT

Figure 1:
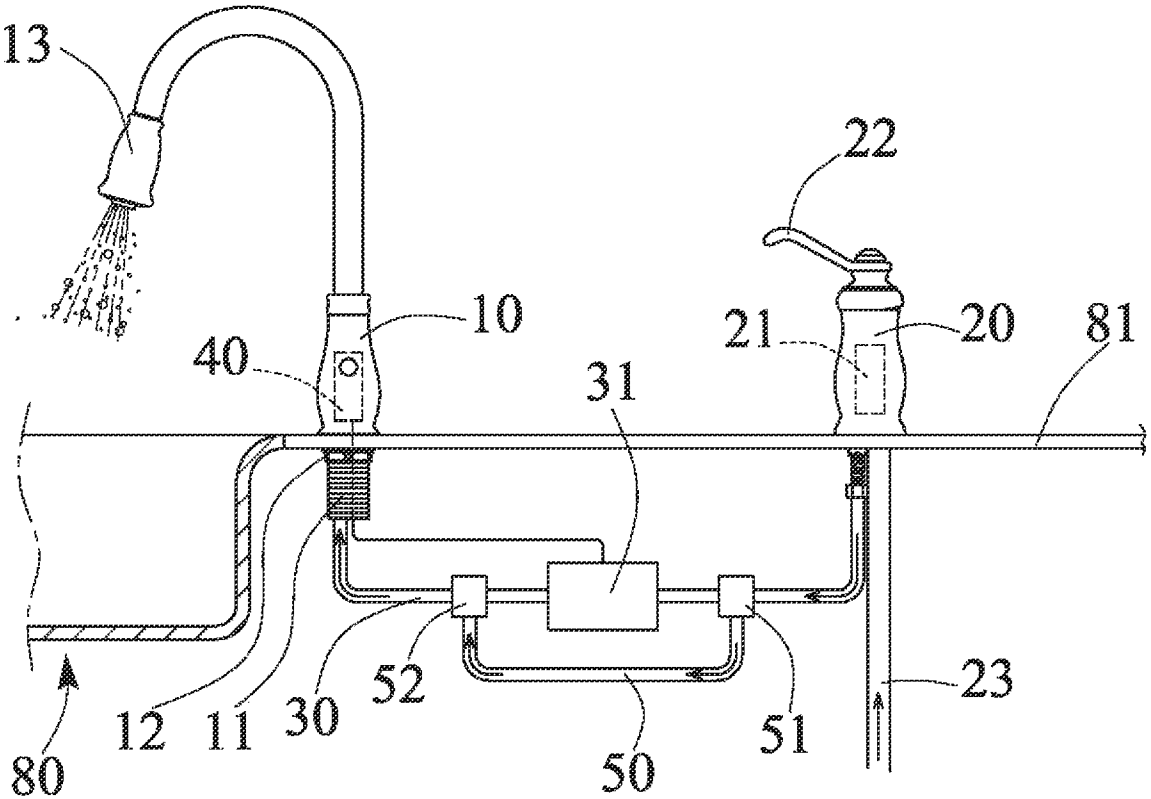
FIG. 1 is a partial plan schematic view illustrating an automatic water flow controller for a faucet device in accordance with the present invention.
Figure 2:
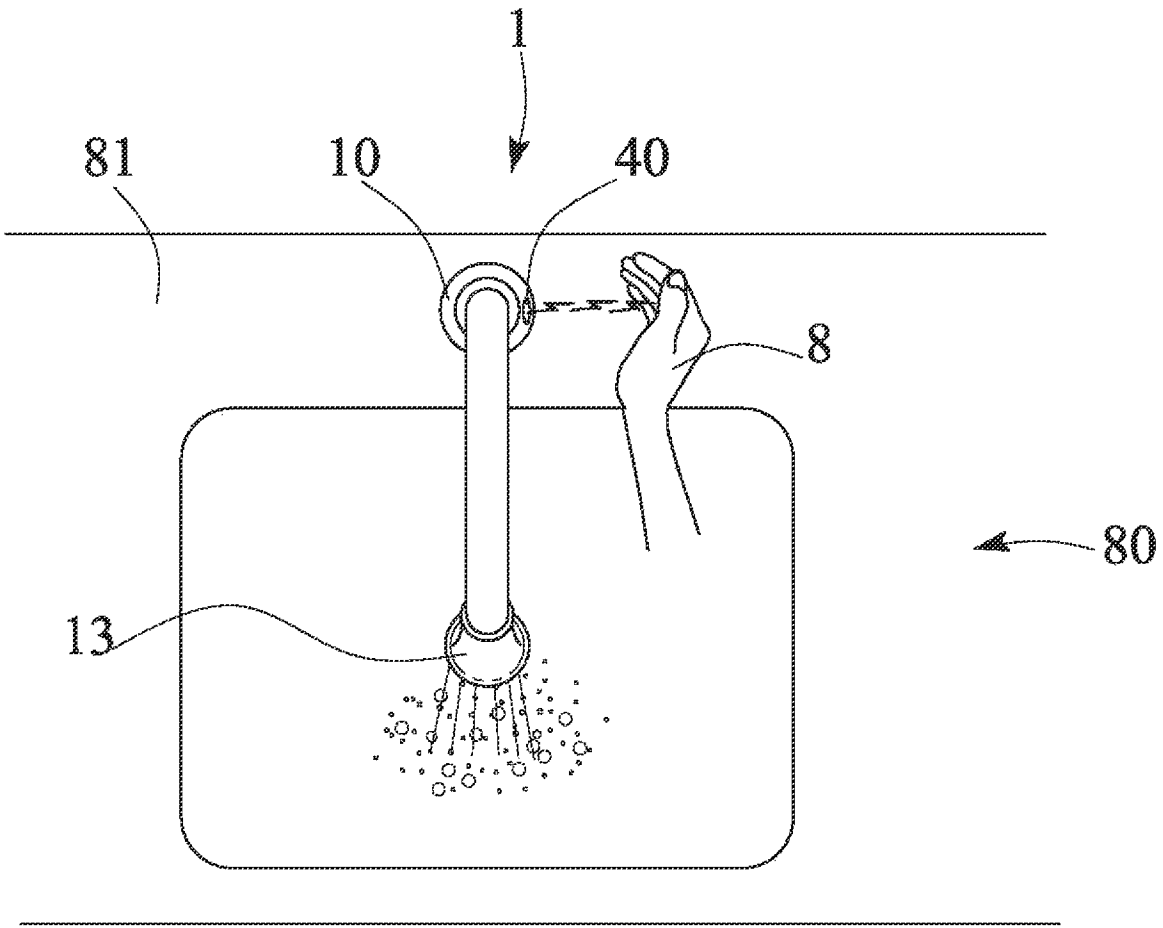

Referring to the drawings, and initially to FIGS. 1 and 2, an automatic water flow controller assembly or device or combination for a faucet device 1 in accordance with the present invention is provided for attaching or mounting or securing to a sink, a basin 80 or the like, and more particularly to a supporting table or surface 81 of the sink or basin 80 or the like, the faucet device 1 comprises an outlet piece or member 10 including a lower or base portion 11 attached or mounted or secured to the supporting table or surface 81 of the sink or basin 80 or the like with latches or fasteners 12 or the like, and including an outlet nozzle or port 13 directed toward the sink or basin 80 for directing or delivering the water into the sink or basin 80 or the like.

The faucet device 1 further comprises a control device 20, such as a manually operated or manual valve device 20 also attached or mounted or secured to the supporting table or surface 81 of the sink or basin 80 or the like with latches or fasteners (not shown) or the like, and including a control valve member 21 disposed or engaged into the manual valve device 20, a handle 22 attached or mounted or secured or coupled to the control valve member 21 of the manual valve device 20 in order to actuate or operate the control valve member 21 of the manual valve device 20, and one or more inlet pipes 23 attached or mounted or secured or coupled to the control valve member 21 of the manual valve device 20 for supplying cold and/or hot water into the manual valve device 20, and the control valve member 21 of the valve device 20 may be used to control or to mix the cold and/or hot water into the required temperature.

A connecting or coupling conduit or tube 30 is further provided and attached or mounted or secured or coupled between the outlet piece or member 10 and the manual valve device 20 for supplying or delivering the mixed cold and hot water from the valve device 20 to the outlet piece or member 10 and then to flow out through the outlet nozzle or port 13 of the outlet piece or member 10 selectively, the handle 22 may actuate or operate the control valve member 21 of the valve device 20 to mix the cold and hot water and to selectively supply or deliver the mixed cold and hot water to flow into the coupling tube 30, when required. The above-described structure or configuration for the control valve member 21 of the valve device 20 is typical and is not related to the present invention and will not be described in further details.

An automatic or electrically operable solenoid valve 31 is disposed or attached or mounted or secured to the coupling tube 30 for controlling the water to flow through the coupling tube 30. A proximity sensor or infrared ray detector 40 is disposed or attached or mounted or secured to the outlet member 10 for detecting an approaching of an object or a user 8 to the outlet member 10 of the faucet device 1 (FIG. 2), and/or within a detection zone of the infrared ray detector 40, the infrared ray detector 40 is electrically connected or coupled to the solenoid valve 31 for actuating or operating the solenoid valve 31 to control the water to flow through the coupling tube 30 selectively. For example, the solenoid valve 31 may be actuated or operated to control the water to selectively flow through the coupling tube 30 when the infrared ray detector 40 detects an approaching of a user 8 to the outlet member 10 of the faucet device 1.

As shown in FIG. 1, a manifold or bypass 50 may further be provided and attached or mounted or secured or coupled to the coupling tube 30, and includes a first end (51) coupled to the coupling tube 30 at the upstream side of the solenoid valve 31 with a valve element 51, such as a three-way valve element 51, and includes a second end 52 coupled to the coupling tube 30 at the downstream side of the solenoid valve 31 directly or indirectly with another valve element (52). In operation, the valve element 51 may be selectively switched or actuated or operated to control or supply or deliver the mixed water to flow into the manifold or bypass 50, and then to flow out through the outlet nozzle or port 13 of the outlet piece or member 10, without flowing through the solenoid valve 31, and for allowing the solenoid valve 31 to be fixed or repaired or changed with the new ones when the solenoid valve 31 id damaged or out of order.

Figure 3:
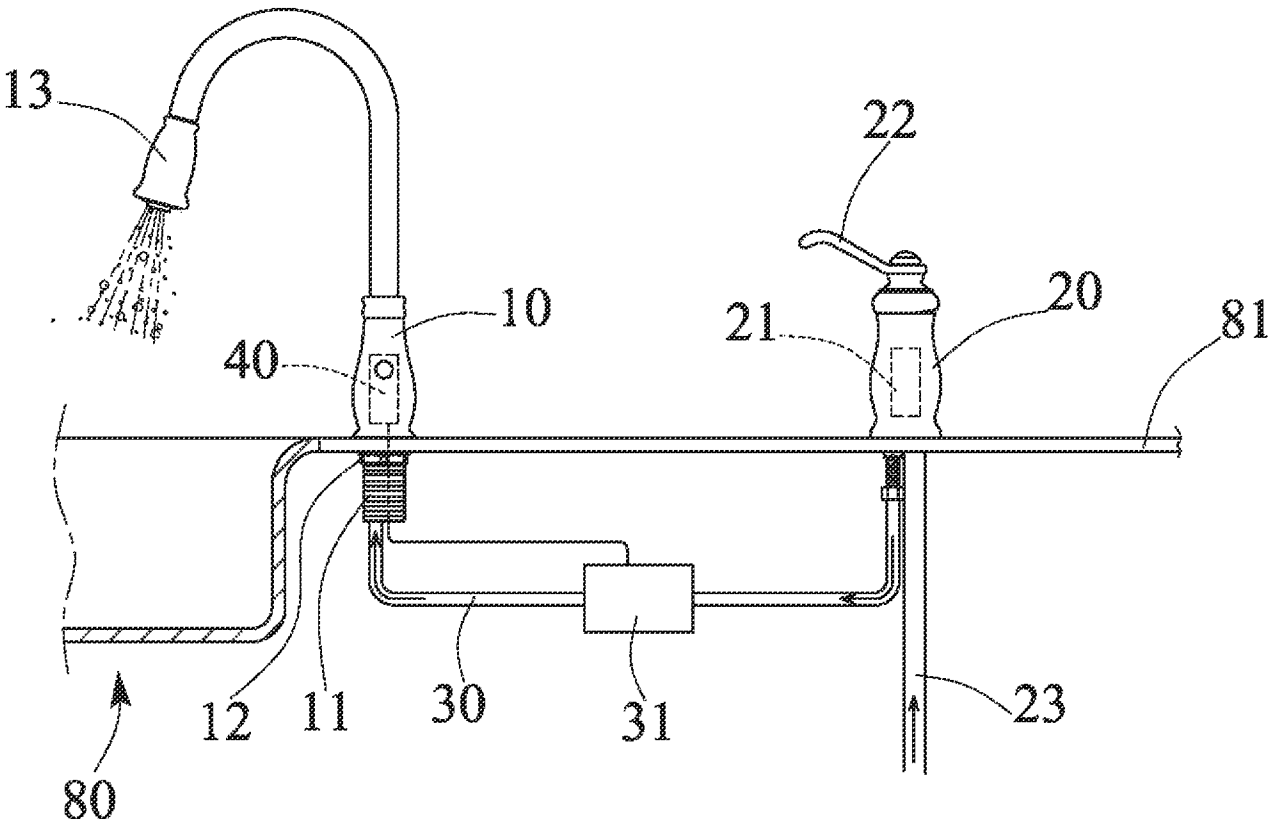
Figure 4:
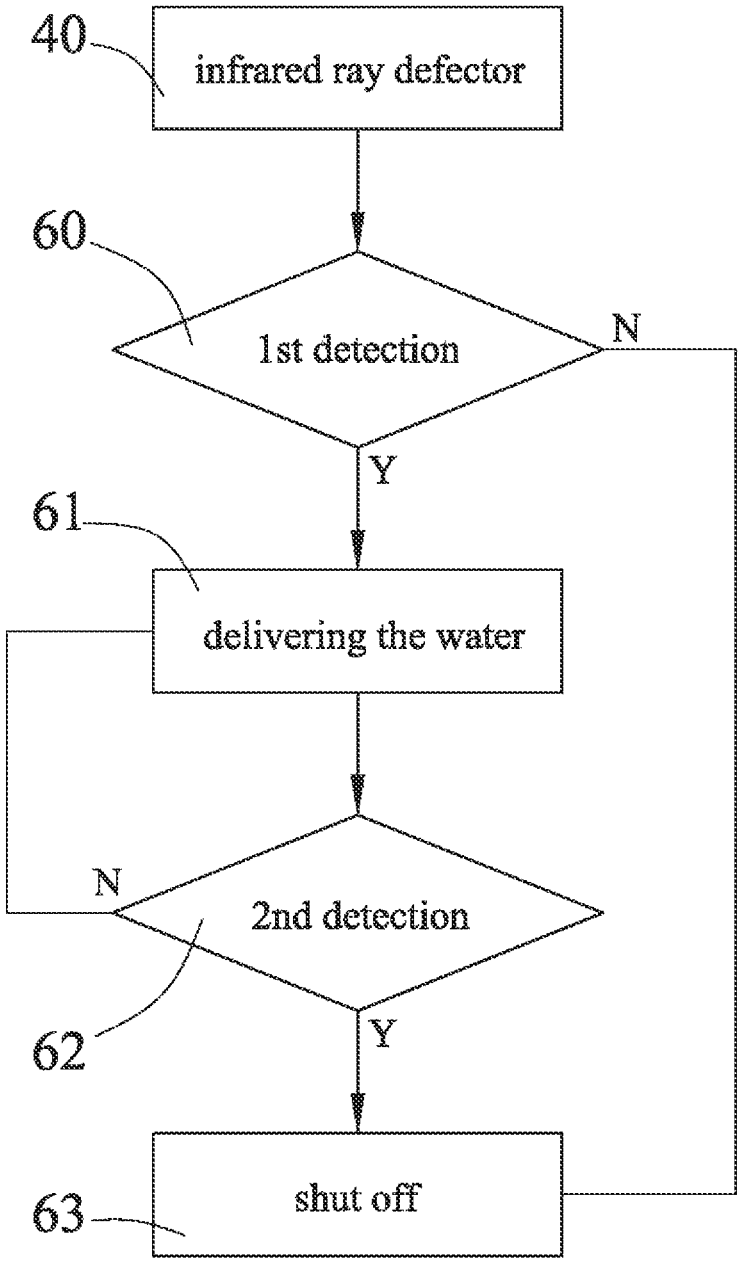

However, it is to be noted that the manifold or bypass 50 is optional, and may be removed from the coupling tube 30, as shown in FIG. 3, and the solenoid valve 31 may also be used to control the water to selectively flow through the coupling tube 30, or to block the coupling tube 30 and to prevent the water from flowing through the solenoid valve 31. In operation, the infrared ray detector 40 may be used to detect an approaching of a user 8 to the outlet member 10 of the faucet device 1, and may selectively actuate or operate the solenoid valve 31 to control the water to flow through the coupling tube 30. Alternatively, the solenoid valve 31 may also be normally opened, and the handle 22 of the valve device 20 may actuate or operate the control valve member 21 of the valve device 20 to mix the cold and hot water and to selectively control and supply or deliver the mixed cold and hot water to flow into the coupling tube 30.

In operation, as shown in FIGS. 1-4, when the valve device 20 is normally opened, and when the infrared ray detector 40 detects a first approaching of a user 8 (FIG. 2) to the outlet member 10 of the faucet device 1 and/or to the infrared ray detector 40, in the process 60, the solenoid valve 31 may be switched or actuated or operated to control or supply or deliver the mixed water to flow out through the outlet nozzle or port 13 of the outlet piece or member 10 in the process 61. When the infrared ray detector 40 detects a second approaching of the user 8 to the infrared ray detector 40 (FIG. 2) in the process 62, the solenoid valve 31 may be actuated or operated or switched off to shut off the mixed water in the process 63. If the second approaching of the user 8 to the infrared ray detector 40 has not been detected, the mixed water may be continuously supplied or delivered to flow out through the outlet nozzle or port 13 of the outlet piece or member 10 in the process 61.

Referring again to FIG. 2, when the user 8 approaches to the outlet member 10 of the faucet device 1, the infrared ray detector 40 may not detect the approaching of the user 8 to the infrared ray detector 40 unless a portion of the user 8, such as one of the hands of the user 8 is moved toward or close to the infrared ray detector 40, such that the infrared ray detector 40 will not false detect the approaching of the user 8 to the outlet member 10 of the faucet device 1. The mixed water may be continuously supplied or delivered to flow out through the outlet nozzle or port 13 of the outlet piece or member 10 as long as the user 8 is required, and may be controlled and shut off when the portion of the user 8 is moved toward or close to the infrared ray detector 40 again. The user 8 is not required to touch or to contact with the solenoid valve 31 and the handle 22 of the valve device 20.

Accordingly, the automatic water flow controller for a faucet device in accordance with the present invention may be provided for automatically controlling a faucet device to deliver the water when detecting an approaching of a user to the faucet device, and includes an infrared ray detector for precisely and accurately detecting an approaching of a user to the faucet device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An automatic water flow controller for a faucet comprising:

an outlet member including an outlet port for delivering water, a manual valve device including a handle that controls said manual valve device, at least one inlet pipe coupled to said manual valve device for supplying the water into said manual valve device, a coupling tube coupled between said outlet member and said manual valve device for supplying the water from said manual valve device to said outlet member and said outlet port of said outlet member selectively, said manual valve device including a control valve member to control the water to selectively flow into said coupling tube, a solenoid valve attached to said coupling tube for controlling the water to selectively flow through said coupling tube, and an infrared ray detector attached to said outlet member for detecting an approaching of a user within a detection zone of said infrared ray detector, said infrared ray detector being electrically connected to said solenoid valve for operating said solenoid valve to control the water to selectively flow through said coupling tube, said infrared ray detector actuating said solenoid valve to control the water to selectively flow through said coupling tube when said infrared ray detector detects a first approaching of the user to said infrared ray detector, and to selectively switch off said solenoid valve when said infrared ray detector detects a second approaching of the user to said infrared ray detector, and a bypass attached to said coupling tube, and said bypass including a first end coupled to said coupling tube at an upstream side of said solenoid valve, and including a second end coupled to said coupling tube at a downstream side of said solenoid valve, and said first end of said bypass being coupled to said coupling tube with a valve element.

* * * * *